United States Patent [19]

Watterson et al.

[11] Patent Number: 5,013,033

[45] Date of Patent: May 7, 1991

[54] ROWING APPARATUS

[75] Inventors: Scott R. Watterson, River Heights; William T. Dalebout; Donald J. Standing, both of Logan, all of Utah

[73] Assignee: Proform Fitness Products, Inc., Logan, Utah

[21] Appl. No.: 305,939

[22] Filed: Feb. 1, 1989

[51] Int. Cl.[5] ..... A63B 69/06

[52] U.S. Cl. ..... 272/72; 272/140

[58] Field of Search ..... 272/72, 73, 140, 132, 272/133, 128; 128/25 R

[56] References Cited

U.S. PATENT DOCUMENTS

| | | | |
|---|---|---|---|
| D. 277,304 | 1/1985 | Smith . | |
| 432,598 | 7/1890 | Bryon, Jr. . | |
| 881,521 | 3/1908 | Wilson . | |
| 1,217,292 | 2/1917 | Firth . | |
| 1,707,791 | 4/1929 | Anderson . | |
| 1,866,868 | 10/1932 | Thomson et al. . | |
| 1,974,445 | 8/1934 | Calleson | 272/72 |
| 1,979,783 | 9/1934 | Williams et al. . | |
| 2,131,570 | 7/1935 | Riley . | |
| 3,586,322 | 6/1971 | Kuerneland . | |
| 4,077,626 | 3/1978 | Newman . | |
| 4,284,272 | 8/1981 | Evans et al. . | |
| 4,592,544 | 6/1986 | Smith et al. | 272/73 |
| 4,625,962 | 12/1986 | Street | 272/72 |
| 4,762,317 | 8/1988 | Camfield et al. | 272/73 |

FOREIGN PATENT DOCUMENTS 2347029 9/1973 Fed. Rep. of Germany .

OTHER PUBLICATIONS

"Multi-Gym" Instruction Course, Best Catalog, one page.

"Vitamaster" catalog for 1985, one page.

*Primary Examiner*—Stephen R. Crow

*Attorney, Agent, or Firm*—Trask, Britt & Rossa

[57] ABSTRACT

A rowing apparatus having an elongate frame, a seat mounted for slidable displacement along that frame and a handle/cable arrangement fixedly mounted to an axle journaled in the frame. The cable being wrapped about a reel mounted on that axle causes a rotation of that axle in a first direction upon a given displacement. The axle is likewise fitted with a spring which is tensioned upon the axle's rotation in a first direction. Upon the storage of sufficeint energy in that spring, the spring effects a counter rotation of the axle to return the cable and its associated handle to its rest position. The axle is fitted with a flywheel, and a means adapted for applying a frictional drag force thereto. The drag means is adapted for controlling the resistance of the handle to displacement outwardly from the frame and further, for controlling the force by which the handle is urged restoringly back to its rest position.

16 Claims, 6 Drawing Sheets

Fig. 3
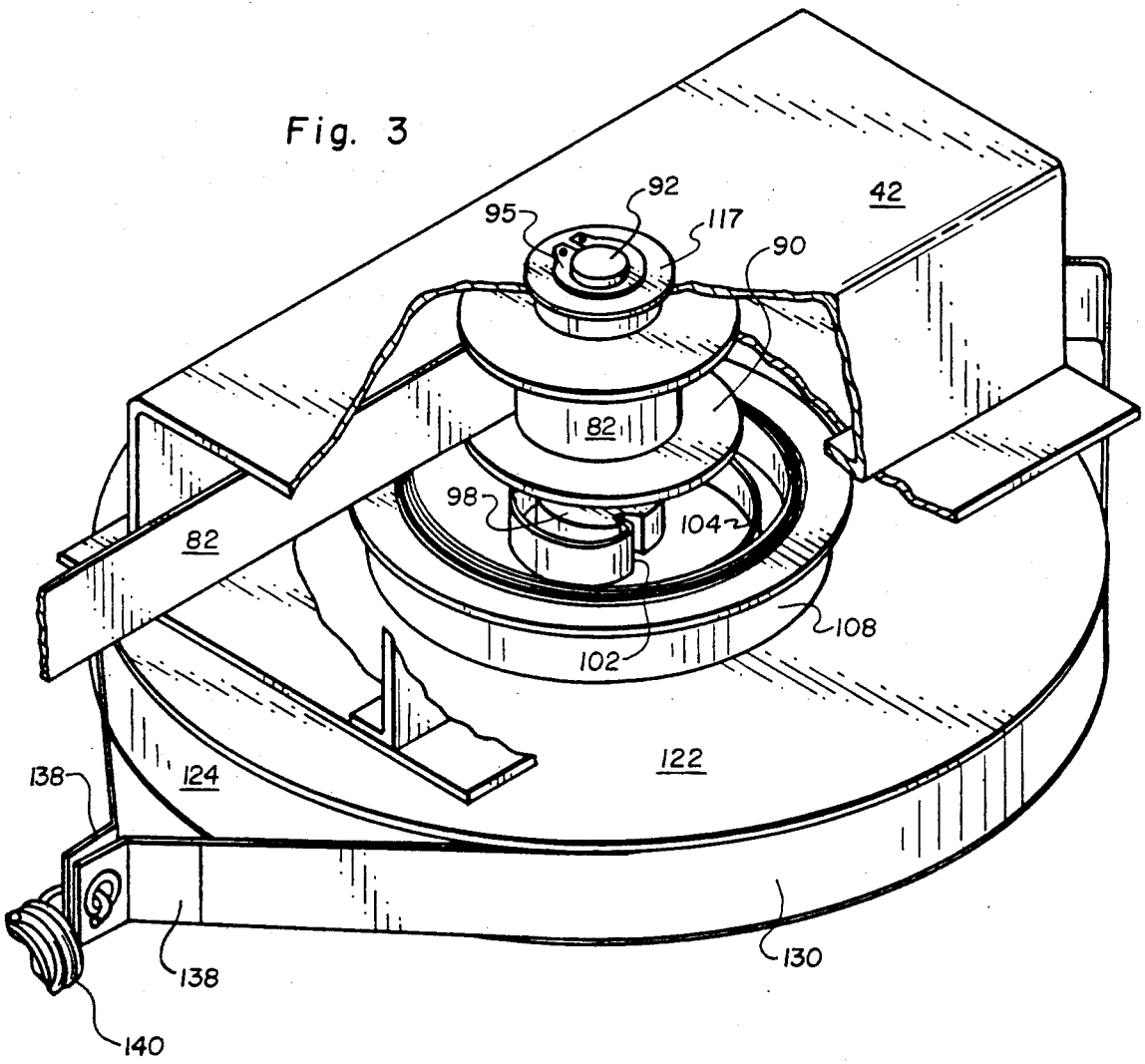
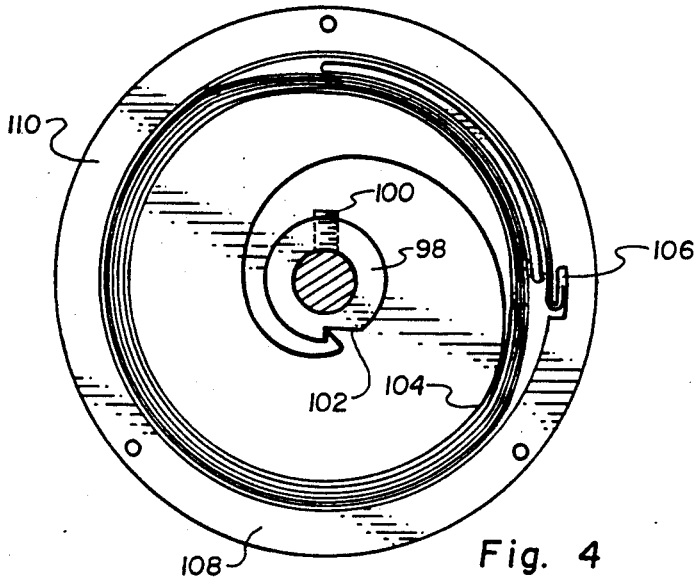
Fig. 4

Fig. 6
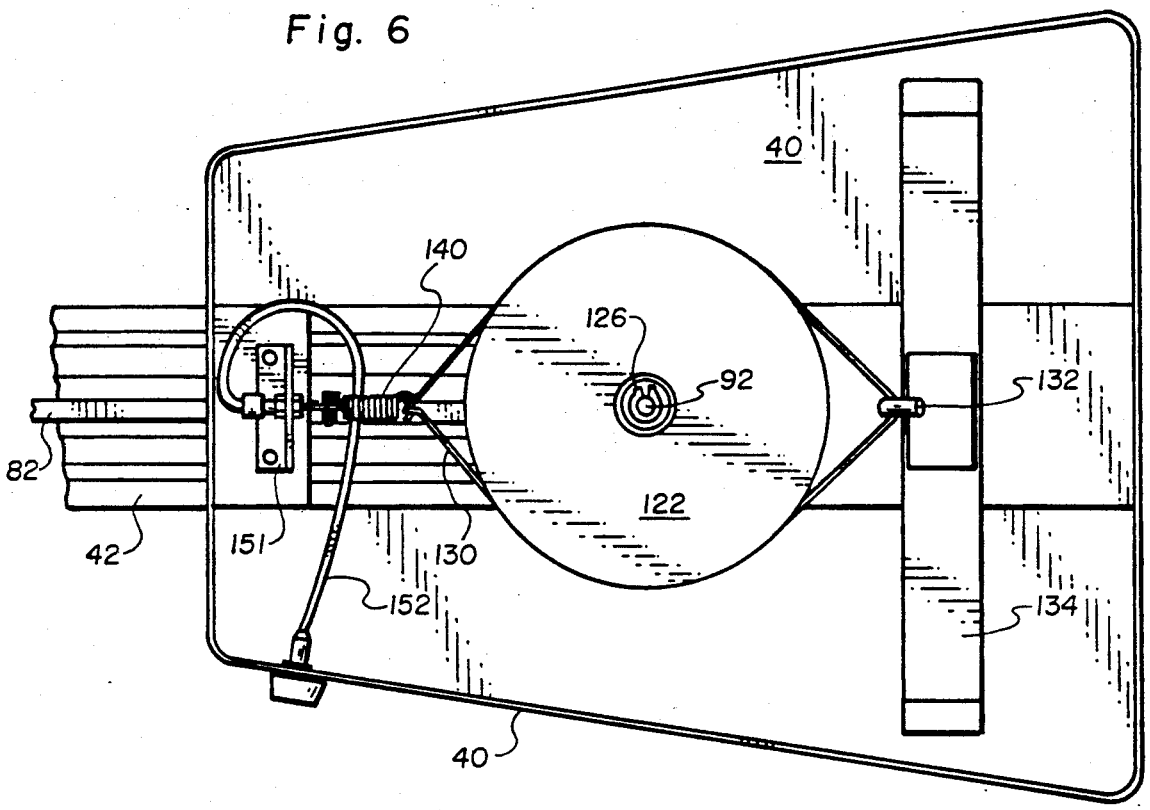
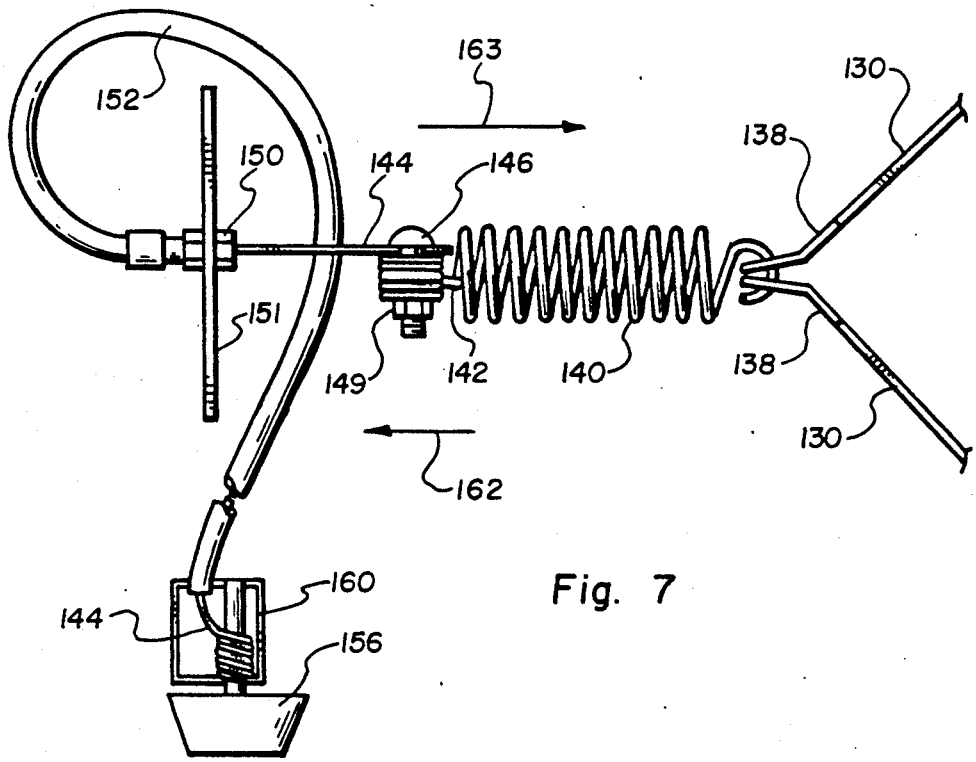
Fig. 7

ROWING APPARATUS

FIELD

This invention is directed to exercise equipment. More particularly, the invention relates to exercise equipment of a type adapted for performing rowing-type exercises.

STATEMENT OF THE ART

The degree and extent of muscular exercise which results from performing exercises which simulate rowing a boat have been recognized for several years. In profiting from this recognition, manufacturers of exercise equipment have designed and constructed a multiplicity of devices which permit the user to simulate rowing. Representative of prior disclosed rowing apparatus include those disclosed in U.S. Pat. Nos. 432,598, 402,467, 881,521, 1,217,292, 1,707,791, 1,866,868, 2,131,570 and 3,586,322.

SUMMARY OF THE INVENTION

The rowing apparatus of the invention includes a support frame which may include a guide track configured therein. A seat, for the user, may be mounted on the guide track so as to be reciprocatingly displaceable along a length of the guide track. A handle having a cable connected thereto is supported on the frame to be graspable, e.g., by an individual seated on the aforesaid seat. One or more foot rests may be provided on the frame, for purposes of the user bracing himself during the apparatus' operation.

The cable of the handle is trained about a reel secured to an axle rotatably journaled in the support frame. A first displacement of the handle by pulling the handle outward from the support frame causes the rotation of the axle in a first direction. A spring means, e.g. a spring configurated in the shape of a conventional watch mainspring, i.e., a spiral spring, is mounted to the axle on its first end and mounted on its second end to a non-rotating structure, e.g., the support frame or a non-rotating housing through which the axle is journaled. The resistance means or spring means is mounted such that a rotation of the axle in the first direction causes the spring means to be tensioned, thereby storing energy therein and causing the spring to exert a restoring force on the axle, urging that axle to rotate in a direction opposite to the first direction.

An energy absorbing means, e.g. a flywheel, is associated with the axle to absorb the energy imparted to the axle by the displacement of the cable. A drag means is associated with the energy absorbing means for dissipating the energy stored in the energy absorbing means. In one embodiment, a spring tensioned band is trained over a region of the flywheel circumference. The band being abutted against the flywheel causes a frictional drag on the flywheel upon that flywheel's angular rotation. By adjusting of the tension being applied to the band, the user is able to control the magnitude of the drag force being applied to the flywheel.

The spring means functions to urge the handle toward a rest position, proximate the support frame. Upon a user diminishing the magnitude of force being applied to the handle or, alternatively, upon the force created by the spring means reaching a magnitude greater than the user applied force, the spring urges the handle into its rest position by rotating the axle on which the flywheel is mounted. The action of the drag means also operates on the flywheel as the handle is restored to its rest position, causing the handle to be returned to its rest orientation at a measured speed. This return action contrasts with the impulse-type handle return of the type common to rowing systems wherein the handle is returned to its rest position by a spring without any force dissipating arrangement associated therewith.

The invention includes means of controlling the magnitude of the drag force being applied to the flywheel. The user is therefore able to simultaneously control the resistance encountered in displacing the handle outwardly from the frame while also controlling the restoring force applied to the handle to return it to its rest position.

BRIEF DESCRIPTION OF THE DRAWINGS

FIG. 3 is a sectional, cut-away view of the flywheel assembly of the invention;

FIG. 4 is a top view of the spring assembly of the flywheel;

FIG. 6 is a bottom view of the flywheel assembly illustrating the flywheel drag assembly;

FIG. 7 is a sectional view of the control mechanism for the flywheel drag assembly;

DETAILED DESCRIPTION OF THE DRAWINGS

Figure 1:
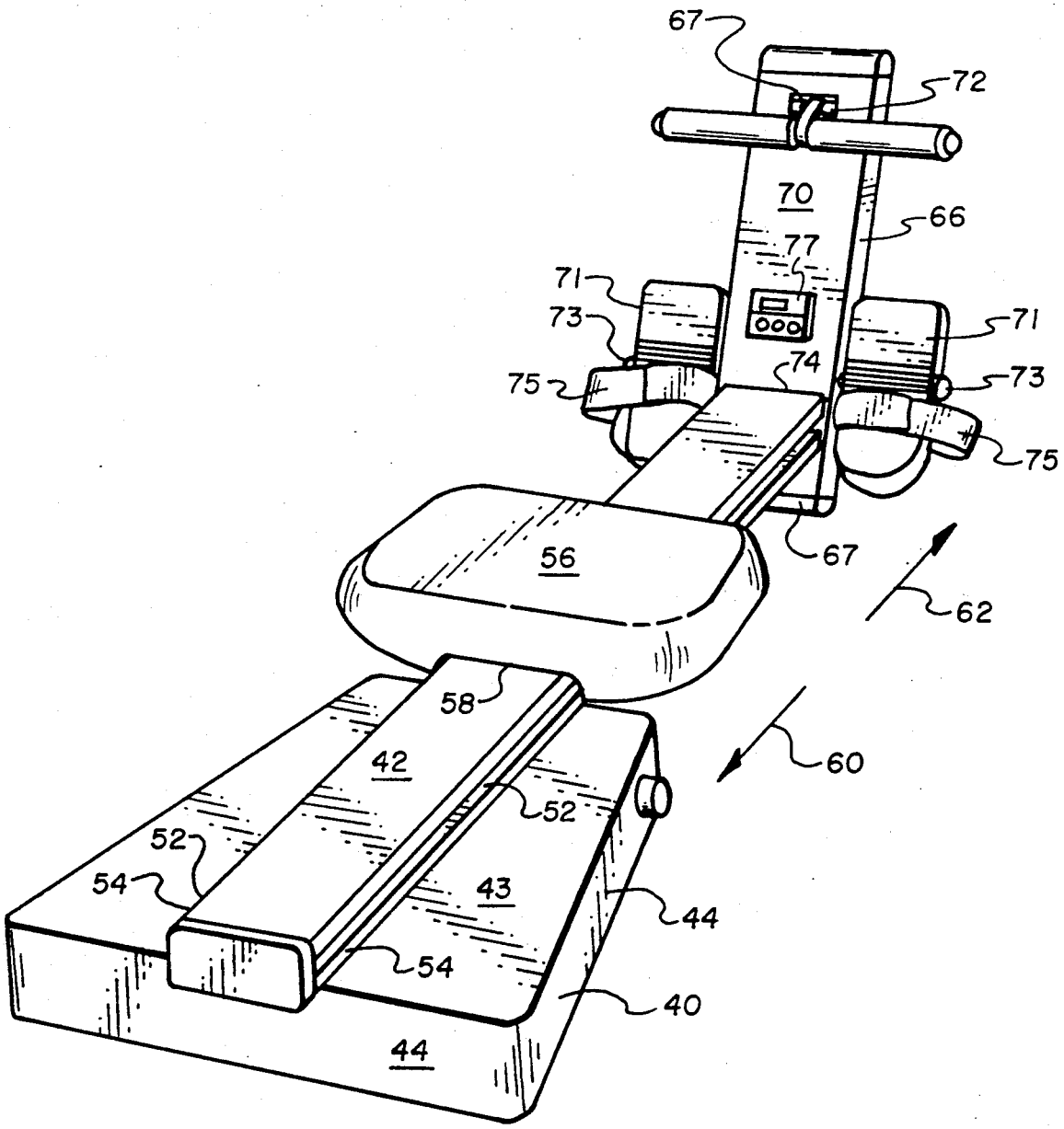
FIG. 1 is a perspective view of a rowing apparatus of the invention illustrating the handle of that apparatus in a rest position.

As shown to advantage in FIG. 1 of the drawings, a rowing apparatus of the instant invention includes a base support housing 40 mounted to a longitudinally extending elongate frame shaft 42. The base support housing 40 has a horizontally oriented planar top 43 and four vertical sidewalls 44 mounted about the circumference of the top. The bottom of the housing is open, as shown to advantage in FIG. 6. The housing 40 forms a support frame for the apparatus. It extends laterally from the frame shaft 42 sufficiently to provide lateral stability to the apparatus. The interior of the housing 40 is hollow and is configured to receive and retain the flywheel assembly 50. (See FIG. 2.)

Frame shaft 42 is a hollow, elongate shaft-like member having a quadrilateral cross-section which remains dimensionally constant over the entire length of the shaft. An elongate, linear channel or recess well 52 is defined in each of the opposing vertical sidewalls 54 of the shaft. The opposing channels 52 form a guide track for a seat 56 which is mounted on the shaft 42 for sliding displacement therealong. The top of the shaft defines a planar horizontal surface. The seat 56 defines an open-sided channel 58 therein which is configured to correspond to and receive the upper surface of shaft 42. The seat 56 includes a pair of roller-fitted flanges oriented proximate the channel 58. Each flange extends in to respective channel 52, thereby engaging with the guide track formed in shaft 42. The seat 56 is thereby adapted for sliding displacement along the length of the shaft 42 in the directions indicated by arrows 60 and 62.

An upright support 66 is mounted on the end of shaft 42 to extend vertically or substantially vertically. As shown in FIG. 1, the support 66 may be angled to the horizon at an angle less than the ninety degrees. The lower end of support 66 forms a foot or support for the rowing apparatus. A pair of foot rests 71 are mounted spacedly apart from one another on the support 66 on opposing sidewalls of that support 66. Each of the foot rests 71 is mounted to the support by a support pin 73. As shown, each foot rest 71 includes an adjustable strap 75 mounted thereon adapted for securing a user's foot against the foot rest during operation of the apparatus.

An electronic monitoring means 77 may be mounted in support 66. Support 66 is an elongate member having a hollow channel 68 which extends along the length thereof. An opening 67 defined within the sidewall surface 70 of the support 66 communicates with that channel 68. A cylindrical rod 72 is mounted on the support 66 proximate the opening 67.

A second opening 74, defined in surface 70, is adapted to receive the end of shaft 42 to form a mounting therefor. The end of shaft 42 is open ended and communicates with an elongate hollow channel 83 which extends along the length of the shaft. The open end 76 of shaft 42 communicates with the channel 68. A cylindrical rod 78 similar to the rod 72 is positioned within the channel 83 of shaft 42 and mounted to the interior wall on that shaft.

Figure 2:
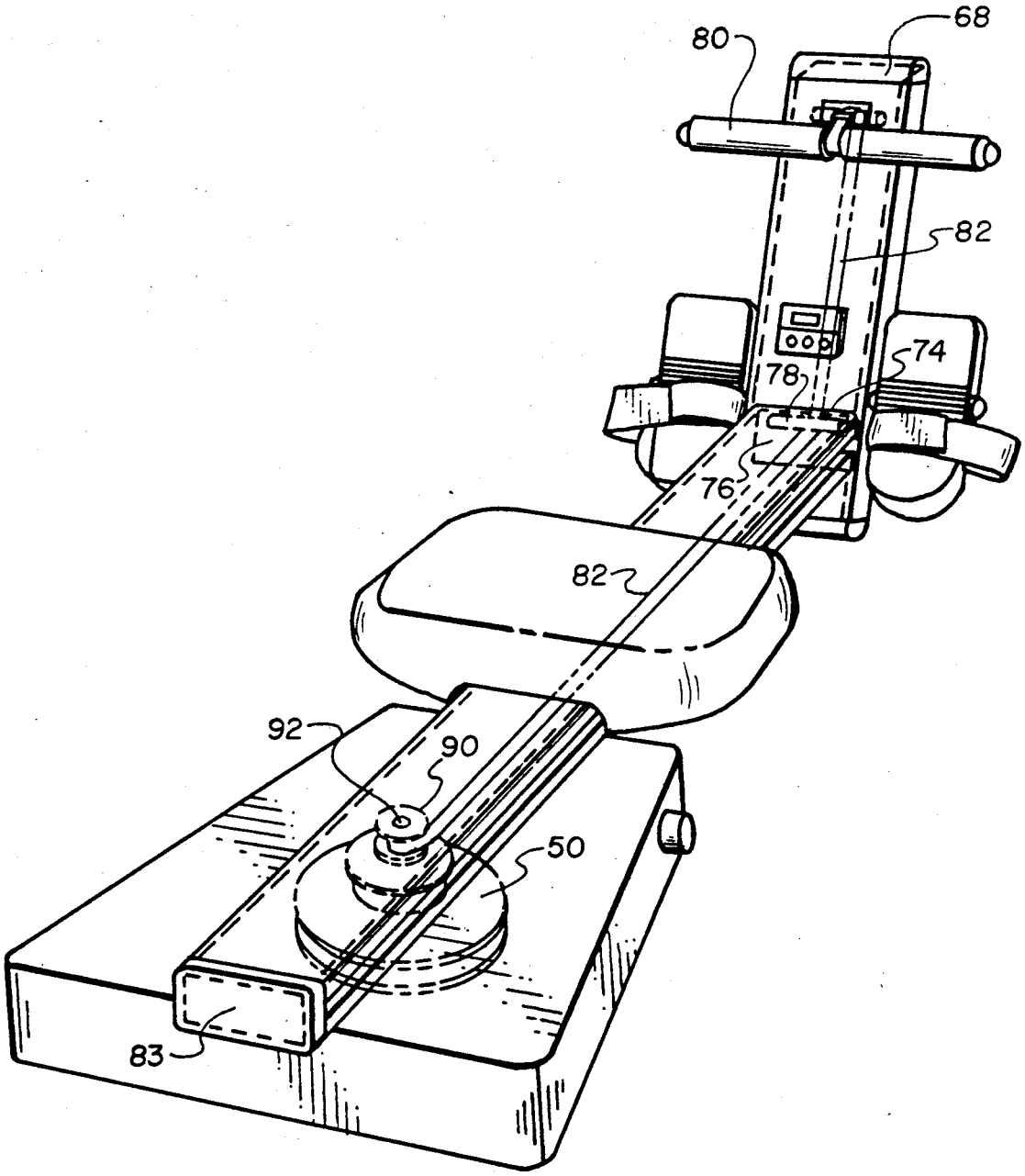
FIG. 2 is a perspective view of the rowing apparatus of FIG. 1 showing the orientation of the band and flywheel assembly therein in phantom.
Figure 8:
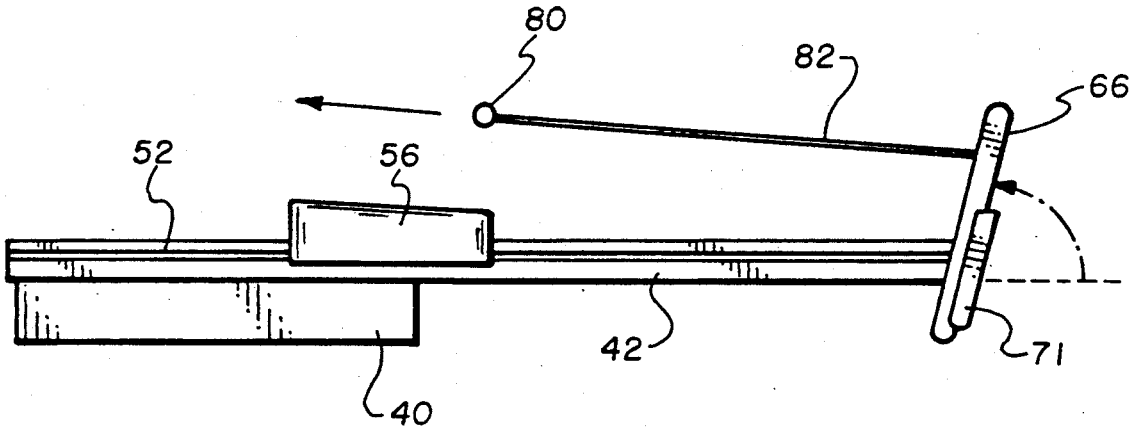
FIG. 8 is a side view of the apparatus of FIG. 1 showing the handle displaced outward from the support frame.
Figure 9:
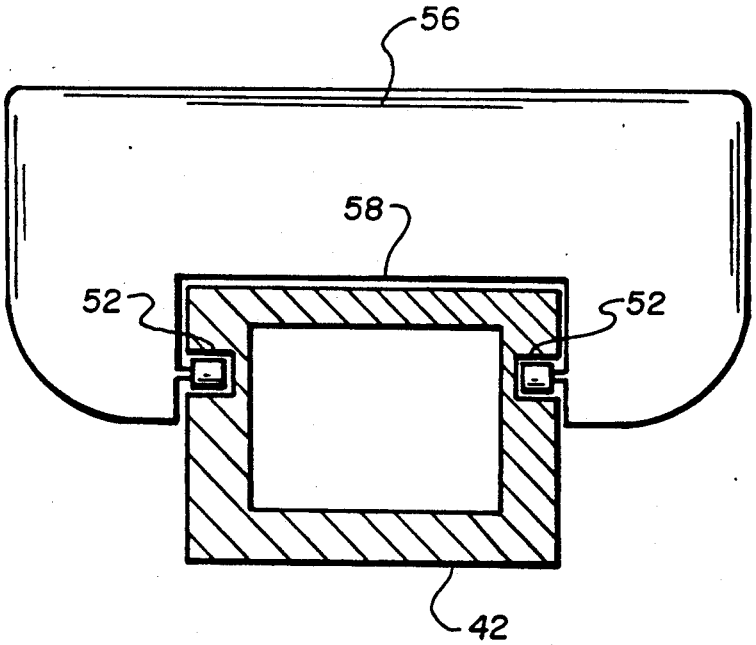
FIG. 9 is an end view of the seat of the apparatus illustrating the flange arrangement thereof.

An elongate, cylindrical rod-like handle 80 is supported on support 66 by a band or cable 82 mounted thereon, which extends through opening 69, is trained over rod 72 and extends through channel 68. The cable 82 is trained over rod 78 and enters shaft 42 by open end 76 and extends through channel 83. As shown in FIGS. 2 and 8, a first section of cable 82 extends from the reel 92 fitted end of support 40 to the foot rest support 66, thereafter a second section of the cable is directed upwards along the vertically disposed height of support 66 and is then trained over rod 72. As shown to advantage in FIG. 8, a third section of the cable 82 then extends outwardly toward the reel 92 fitted end of support 40. Understandably, as the handle 80 is displaced, the first section of cable 82 is displaced in a direction which is approximately 180 degrees removed from the direction of travel of the third section of cable 82.

Figure 5:
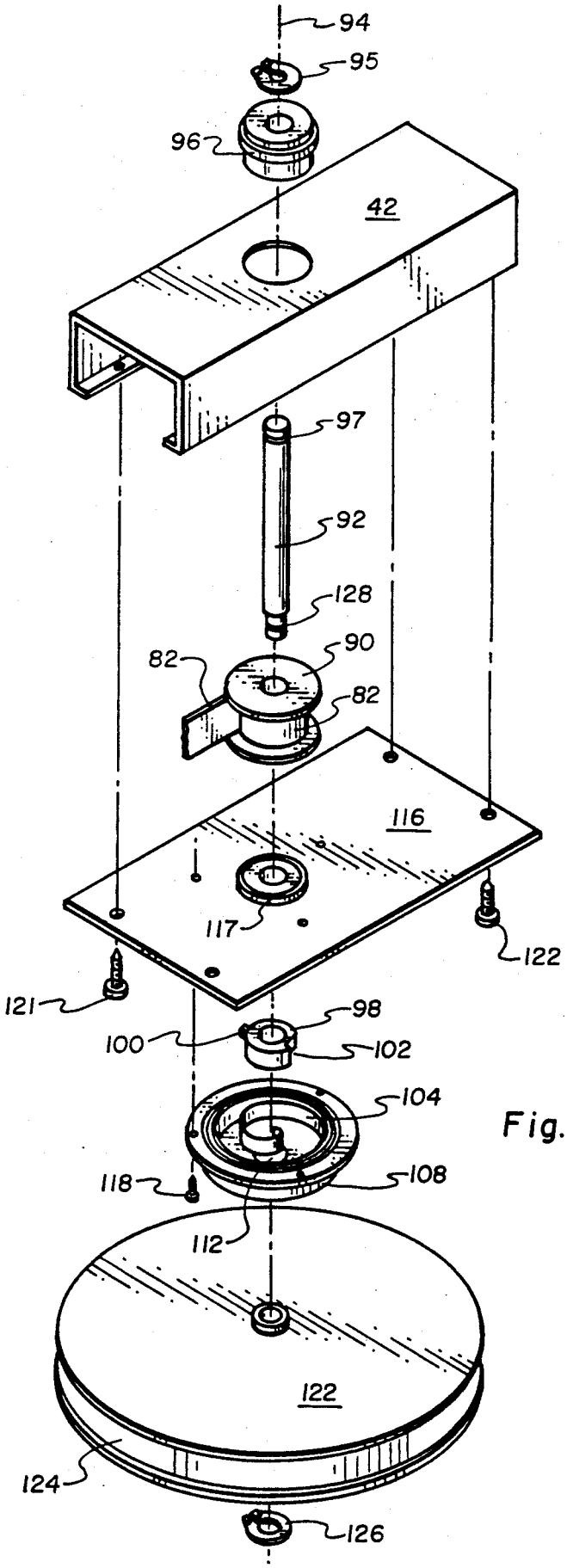
FIG. 5 is an exploded view of the flywheel assembly of the invention.

Cable 82 is secured to and wound about a cylindrical reel member 90 which is fixedly mounted to a vertically upright oriented axle 92. As shown to advantage in FIG. 5, axle 92 is an elongate cylinder shaft journaled on shaft 42 for rotation about a vertically oriented axis of rotation 94. The axle 92 is retained on shaft 42 by a spring "C"-clip 95 mounted within an annular groove 97 on axle 92. The axle 92 is journaled through a flanged bearing mount 96 retained within shaft 42. Mounted on shaft 42 below the mounting of reel 90 is a substantially cylindrically shaped collar fitting 98 which is secured to the axle 92 by means of a male threaded member 100 which is threadedly inserted through a female threaded aperture defined within the sidewall of collar fitting 98. Member 100 abuts against axle 92 to form a pressure-type abutment coupling sufficient to secure the collar 98 against the axle 92. Collar 98 defines a notch 102 therein dimensioned and configured to retain the hook-shaped end of a spiral configured spring 104. The opposing end of the spring 104 is formed into a hook-like configuration and is detachably mounted within a slot 106 defined within a cylindrical housing 108 (FIG. 4). As illustrated in FIG. 5, housing 108 is a generally cylindrical member having an annular flange 110 mounted on its upper end. The housing defines a substantially cylindrical hollow interior. Spring 104 is mounted and retained within that hollow cylindrically configured interior. Housing 108 defines a circular opening 112 therein through which axle 92 passes. The opening 112 is dimensioned such that the axle 92 freely rotates within the opening 112.

Housing 108 is fixedly mounted to a planar retaining plate 116 by means of three retaining screws 118 which pass through openings in the annular flange of the housing 108 and are subsequently threaded into apertures defined within plate 116. FIG. 5 illustrates only one of the screws 118, the other two screws having been removed for clarity purposes. As further shown in FIG. 5, plate 116 is detachably secured to shaft 42 by a plurality of screws 121. The axle 92 is journaled through a flange-fitted bearing mount 117 mounted within plate 116.

Within the second end of spring 104 being secured to housing 108, any rotation of axle 92 in a counterclockwise rotation (when viewed from above, see FIG. 4) causes the spring 104 to be put into tension and stores restoring energy in that spring. Upon the release of a force application on the axle 92, the spring 104 causes a restoring, clockwise rotation of the axle 92.

A cylindrically configured flywheel 122 is fixedly mounted on axle 92, whereby the flywheel is rotated together with the axle. Flywheel 122 includes a recess well or channel 124 configured in its upstanding sidewall.

Flywheel 122 is retained on axle 92 by a spring "C"-clip 126 which is received within an annular groove 128 configured in axle 92.

FIGS. 3 and 6 illustrate an arrangement adapted for producing a drag-resisting force on flywheel 122. As shown, a thin band or cable member 130 is positioned about the circumference of flywheel 122 and within recess channel 124. Band 130 is dimensioned to be longer than the circumference of flywheel 122. The band 130 is trained around a hook-like member 132, mounted to a frame member which 134, which extends downward from shaft 42 into the hollow interior of housing 40. As shown in FIG. 6, hook-like member 132 retains a section of band 130 which is generally defined as being positioned midway between the opposing ends of the bank 130 out of contact with the flywheel 122. A first section of the band 130 which extends from end 138A to the section retained out of contact from the flywheel by hood-like member 132 is in large part trained over the flywheel 122. Likewise, a second section of the band 130 which extends from the end 138B to the section of the bank retained out of contact with the flywheel 122 by hook-like member 132 also is in large part trained over the surface of flywheel 122. The free ends of band 130 are each fitted with aperture defining fittings 138. As shown to advantage in FIG. 7, the fittings 138 are slipped over the hook-defining end of a coil spring 140. Spring 140 is connected on its end 142 to a cable 144 by means of a threaded bolt 146. Cable 144 is wound around the shank of bolt 146. Alternatively, the end of cable 144 may be fitted with an eyelet defining fitting, through which eyelet the bolt passes. The head of the bolt 146 is sufficiently large that it is precluded from passing through the eyelet. The end 142 of spring 140 is wrapped around the shank of bolt 46 and retained in place by a nut 149. Cable 144 is journaled through an aperture-defining fitting 150 mounted in bracket 151. Bracket 151 is mounted on shaft 42. The cable 144 is slidably retained within a plastic jacket 152 which is mounted on its first end to fitting 150. Cable 144 is mounted on its second end to the elongate shank of a knob 156 mounted rotatably in the sidewall of housing 40.

As shown in FIG. 7, plastic jacket 152 is secured to a hollow housing 160, which housing is secured to housing 40. Cable 144 exits the end of jacket 152 and is thereafter wound about the shank of knob 156. Upon a given rotation of knob 156, cable 144 is further wound about that knob, causing a displacement of the end 142 of spring 140 in the direction indicated by arrow 162. The displacement of spring end 142 causes the tensioning of spring 140 and the resultant tightening of band 130 about flywheel 122, as the ends of that band are urged likewise in the direction of arrow 162 by the spring 140. The tightening of the band 130 increases the pressure applied to the surface of the flywheel 122 by the band, thereby causing an increasing frictional drag on the flywheel 122 as that flywheel 122 is turned by the displaced handle-induced rotation of axle 92.

A rotation of knob 156 in an opposite direction causes the cable 144 to feed off the knob's shank 156, thereby displacing the end 142 of spring 140 in the direction illustrated by arrow 163. This in turn releases tension on the band 130 and thereby contributes to diminishing the pressure of the band 130 against flywheel 122 and hence a lessening of the drag force induced on the flywheel by the band 130.

In operation, a user seats himself on seat 56 and places his feet on the foot rests 71. He then reaches forward and grasps handle 80 with one or both hands. By pulling on the handle 80, and thereby displacing that handle outward away from support 66, the cable 82 is unwound from reel 90 causing the counterclockwise rotation of axle 92. As axle 92 is rotated, the spring 104 is tensioned. Further, the flywheel 122 is likewise rotated counterclockwise due to its mounting on axle 92. The rotation of flywheel 122 is opposed by the rubbing action of the flywheel 122 against band 130 which band is held in contact therewith by spring 140. As the user continues to pull on handle 80, the restoring energy stored in spring 104 increases. As energy is stored in the spring 104, the spring applies a restoring force to axle 92, urging that axle to rotate clockwise. As the user begins to ease up on the amount of the pulling force applied to the handle 80, the spring 104 urges the axle 92 to rotate in a clockwise rotation and thereby urges the reel 90 to collect the cable 82 thereon. When the pulling force applied by the user becomes less than the restoring force applied by spring 104, the handle 80 is drawn toward the support 66 as the spring 140 causes a clockwise rotation of axle 92 and the band 82 is collected on reel 90. Since the axle 92 is mounted on flywheel 122, the speed of the return action of restoring the handle 80 to its rest position proximate the support 66 is moderated by the necessity of axle 92 being required to rotate flywheel 122 against the drag force produced by band 130. Band 130 applies a drag force not only against the pulled handle 80 induced rotation of the flywheel 122, but likewise, applies a drag force to the flywheel during the spring 104 induced restoration of the handle 80 to its rest orientation.

The invention provides a means of restoring the handle 80 to its rest position at a measured speed instead of the rapid impulse-like return which characterizes devices wherein the handle is returned by an unfettered spring.

The invention provides a means whereby the user is exercised by pulling the handle outward from the support 66 in opposition to the spring 104, and is further exercised in resisting the spring 104 induced return of the handle 80 to its rest position.

Reference herein to details of the illustrated embodiments is not intended to limit the scope of the appended claims, which themselves recite those features regarded as essential to the invention.

We claim:

1. An exercise apparatus comprising:

a support frame;

a flywheel rotatably associated with said support frame by means of a generally vertical axle journaled in said support frame;

a cable having a first end mounted to said axle and a second end, said cable being wound about said axle;

a handle means mounted on said second end of said cable for permitting a user to displace said cable; and spring means mounted on said support frame and said axle, for effecting a reactive rotational return force on said axle in opposition to a force imparted thereto by a user displacement of said handle means;

drag means mechanically associated with said flywheel for effecting a reaction force on said flywheel in opposition to said force applied thereto by a displacement of said handle means;

said drag means comprising:

an elongate band having opposing ends, said elongate band being trained about said flywheel;

a spring having a first end mounted on said support frame and a second end connected to both of said opposing ends of said elongate band for tensioning said elongate band thereby applying a selected pressure against said flywheel for creating a frictional force on said flywheel upon said flywheel's rotation; and control means associated with said spring for controlling a magnitude of said tensioning.

2. The apparatus of claim 1 wherein said control means includes:

a retaining hook mounted on said support frame;

said retaining hook engaging said elongate band at a location between said opposing ends of said elongate band, said retaining hook retaining a section of said elongate band, located between said opposing ends of said elongate band, out of contact with said flywheel.

3. The apparatus of claim 1 wherein said control means comprises:

a knob rotatably mounted on said support frame;

a second cable secured to said knob and wound thereabout, said second cable being connected to said elongate band;

wherein a rotation of said knob wraps said second cable about said knob and thereby tensions said elongate band about said flywheel to increase the frictional drag force imparted to said flywheel by said elongate band.

4. The apparatus of claim 1 wherein said support frame includes a pair of foot rests.

5. The apparatus of claim 1 wherein said support frame includes an elongate guide track and a seat slidingly mounted on said elongate guide track for reciprocable displacement along a length of said guide track.

6. The apparatus of claim 2 wherein said elongate band is trained on said flywheel along a first region of said elongate band defined between a first said opposing end of said elongate band and said engagement of said elongate band with said retaining hook and said elongate band being trained on said flywheel along a second region of said band defined between a second said opposing end of said elongate band and said engagement of said elongate band with said retaining hook.

7. The apparatus of claim 2 wherein said engagement of said elongate band with said retaining hook is positioned diametrically opposite about said flywheel from said opposing ends of said elongate band.

8. The apparatus of claim 2 wherein said retaining hook's engagement with said elongate band is located along the length of said elongate band midway between said opposing ends of said band.

9. An exercise apparatus comprising:

an elongate support frame having a first end and a second end;

a pair of foot rests mounted on said elongate support frame proximate said first end of said elongate support frame;

an elongate guide track mounted on said elongate support frame;

a seat, slidably mounted on said elongate guide track for reciprocable displacement along a length of said elongate guide track;

an axle journaled into said elongate support frame proximate said second end of said elongate support frame;

a flywheel mounted on said axle;

a cable having a first end and a second end, said cable's first end being wound about said axle;

a first section of said cable extending outwardly from said axle along said elongate guide track to said first end of said elongate support frame, a second section of said cable being directed along a vertically disposed section of said elongate support frame, a third section of said cable being trained over said elongate support frame to be directed toward said second end of said elongate support frame;

a handle, secured to said cable's second end adapted for imparting a rotation producing force to said axle upon a displacement of said handle; and spring means mounted on said axle and to said elongate support frame, said spring means being adapted for applying a reactive, rotational restoring force to said axle in opposition to said handle produced force, wherein upon a displacement of said handle, said first section of said cable is displaced in a direction generally 180 degrees from a direction of displacement of said third section of said cable.

10. The apparatus of claim 9 wherein said flywheel includes a drag producing means associated therewith adapted for dissipating energy absorbed by said flywheel.

11. The apparatus of claim 10 wherein said drag producing means comprises:

a band secured to said elongate support frame; and a tensioning means mounted on said band adapted for urging said band into abutment against said flywheel.

12. The apparatus of claim 11 wherein said elongate tensioning means comprises a spring mounted to said band on its first end and mounted to said support frame on its second end.

13. The apparatus of claim 12 wherein said elongate support frame is fitted with a control means adapted for tensioning said elongate spring, thereby tensioning said band and increasing a magnitude of a frictional drag force applied to said flywheel by said band.

14. The apparatus of claim 13 wherein said control means comprises:

a knob journaled in said support frame and having a shank;

a control cable having a first end secured to said elongate knob and wrapped about said shank, a second end of said control cable being mounted to said second end of said spring;

wherein a rotation of said knob effects a wrapping of said control cable about said shank, thereby tensioning said spring to apply a tensioning force application to said band, thereby increasing said frictional drag force on said flywheel.

15. The apparatus of claim 14 wherein said cable is journaled through a bracket mounted on said elongate support frame proximate said flywheel.

16. An exercise apparatus comprising:

an elongate support frame having a first end and a second end;

a pair of foot rests mounted on said elongate support frame proximate said first end thereof;

an elongate guide track mounted on said elongate support frame;

a seat, slidably mounted on said elongate guide track for reciprocable displacement along a length of said elongate guide track;

an axle journaled in said elongate support frame proximate said second end of said elongate support frame;

a flywheel mounted on said axle;

a reel mounted on said axle;

a first band having a first end secured to said reel and extending outwardly from said reel along said elongate guide track said first band being slidably retained on said elongate support frame;

a handle mounted to a second end of said first band;

a clock spring having a first end mounted to said axle, and a second end mounted to said elongate support frame, said clock spring effecting a restoring, rotation-inducing force on said axle in opposition to a rotation induced by a displacement of said handle;

a second band, oriented in a substantially circular configuration, secured to said support frame and draped about a circumference of said flywheel;

a coil spring mounted on its first end to said second band;

a control cable mounted said coil spring's second end; and a control knob, having a shank, journaled in said elongate support frame, said control cable being wound about said control knob shank, wherein a rotation of control knob effects a winding of said control cable about said shank, thereby tensioning said coil spring and urging said second band into a pressured abutment against said flywheel;

wherein said second band effects a drag producing force on said flywheel in opposition to said spring induced restoring force on said axle to retard a return of said handle to rest position of said handle.

* * * * *

UNITED STATES PATENT AND TRADEMARK OFFICE

CERTIFICATE OF CORRECTION

PATENT NO. : 5,013,033

DATED : May 7, 1991

INVENTOR(S) : Scott R. Watterson, et al

It is certified that error appears in the above-identified patent and that said Letters Patent is hereby corrected as shown below:

Col. 4, line 44, delete "which" (first occurrence).

Col. 4, line 49, delete "bank" and add ---band---.

Col. 4, line 52, delete "hood" and add ---hook---.

Col. 4, line 68, delete "46" and add ---146---.

Col. 7, line 2, after "said" and before "guide" insert ---elongate---.

Col. 8, line 1, delete "elongate".

Col. 8, line 7, delete "elongate".

Col. 8, line 12, after "said" and before "support" insert ---elongate---.

Col. 8, line 15, delete "elongate".

UNITED STATES PATENT AND TRADEMARK OFFICE

CERTIFICATE OF CORRECTION

PATENT NO. : 5,013,033

DATED : May 7, 1991

INVENTOR(S) : Scott R. Watterson, et al

It is certified that error appears in the above-identified patent and that said Letters Patent is hereby corrected as shown below:

Column 4, line 55, delete "bank" and add --band--.

Signed and Sealed this

Second Day of March, 1993

*Attest:*

STEPHEN G. KUNIN

*Attesting Officer*

*Acting Commissioner of Patents and Trademarks*